United States Patent [19]

Misuda et al.

[11] Patent Number: 4,879,166

[45] Date of Patent: Nov. 7, 1989

[54] CARRIER MEDIUM FOR A COLORING MATTER

[75] Inventors: Katsutoshi Misuda; Takafumi Hasegawa, both of Yokohama, Japan

[73] Assignee: Asahi Glass Company, Ltd., Tokyo, Japan

[21] Appl. No.: 216,016

[22] Filed: Jul. 7, 1988

[30] Foreign Application Priority Data

Jul. 7, 1987 [JP] Japan ..... 62-167808

[51] Int. Cl.[4] ..... B41M 5/00

[52] U.S. Cl. ..... 428/212; 428/195; 428/206; 428/304.4; 428/329; 428/331

[58] Field of Search ..... 428/212, 207, 211, 215, 428/216, 327–336, 195, 206, 304.4

[56] References Cited

U.S. PATENT DOCUMENTS 4,460,637 7/1984 Miyamoto et al. ..... 428/212

*Primary Examiner*—Ellis P. Robinson
*Assistant Examiner*—P. R. Schwartz
*Attorney, Agent, or Firm*—Oblon, Fisher, Spivak, McClelland, Maier & Neustadt

[57] ABSTRACT

A carrier medium for a coloring matter, which comprises an ink absorbent and a substance present on the surface of the absorbent, which has an adsorptivity of from 20 to 100 mg/g.

14 Claims, No Drawings

CARRIER MEDIUM FOR A COLORING MATTER

The present invention relates to a carrier medium for a coloring matter. Particularly, it relates to a recording medium for a recording sheet for an ink jet printer, which is capable of providing a sharp color image.

The ink jet recording system has been widely adopted in the fields of e.g. color copying machines or hard copies of computers or video recorders, since it can readily be adapted for full color printing or high speed printing.

In these fields, it is required that (1) the resolution is high, (2) the color reproducibility is good (i.e. a consistent tone is sufficiently secured), (3) high speed printing is possible, and (4) the stability is good. In order to meet such requirements, various improvements have been made from both aspects of hard (printers) and soft (recording materials). However, the performance of the recording materials is behind that of the printers. The recording materials are required to satisfy that (1) the color density of each ink dot is high, (2) they readily absorb the ink, (3) the ink dots spread to a proper extent, and (4) they have practically sufficient strength.

Heretofore, recording materials of this type have been prepared by coating porous silica particles together with a binder such as polyvinyl alcohol on the surface of a sheet, so that an ink is absorbed in a coated layer for color forming.

However, such recording materials have drawbacks such that the faster the absorption of ink is, the lower the color density tends to be, since ink diffuses inwardly from the surface, and the lower the overall color density of the printed images tends to be, since ink dots become small. In order to overcome such drawbacks, it has been proposed to adopt a multi-layer structure for the ink absorbing member. However, no adequate improvement has been accomplished.

The present inventors have conducted various researches and studies to overcome the above-mentioned drawbacks and to meet the above-mentioned four requirements for recording materials, particularly to develop a means whereby the absorption of ink is fast, the color density is sufficient and a sharp image is obtainable. As a result, they have found it possible to accomplish such objects by using a certain specific substance together with an ink absorbent such as porous silica.

Thus, the present invention provides a carrier medium for a coloring matter, which comprises an ink absorbent and a substance present on the surface of the absorbent, which has an adsorptivity of from 20 to 100 mg/g.

Now, the present invention will be described in detail with reference to the preferred embodiments.

In the present invention, the substance present on the surface of the ink absorbent is required to have an adsorptivity of from 20 to 100 mg/g. If the adsorptivity is less than this range, it is difficult to attain adequate color forming and resolution. On the other hand, if it exceeds the above range, no further improvement in the effects is obtainable, and such operation merely adds to the cost.

For the purpose of the present invention, the absorptivity is defined as follows.

In 100 cc of water, 1 g of powder having an average particle size of 15 μm is introduced at room temperature. Under stirring, an aqueous solution containing 2% by weight of Food Black 2 is dropwise added thereto at a rate of 1 cc/min, whereby the adsorptivity is determined by the solid content (mg/g) of the dye adsorbed by the powder at the time when the solution has started to be colored.

As a typical and preferred substance having the above-mentioned physical properties which may be used in the present invention, aluminum oxide or its hydrate having a total volume of pores having radii of from 30 to 100 Å of from 0.2 to 1.5 cc/g may be mentioned. For the determination of such physical properties, the distribution of pores of a dried solid content of alumina sol is measured by Omnisorp 100 manufactured by Omicron Technology Corporation by a nitrogen adsorption method (continuous volumetric flow method). More preferably, the substance is aluminum oxide or its hydrate having a total volume of pores having radii of from 30 to 100 Å of from 0.4 to 1.0 cc/g. Such substance may be crystalline or non-crystalline, and it may be in any suitable form such as spherical particles or particles having no regular form. Particularly preferred as the substance to be used in the present invention is a geled substance obtained by drying alumina sol.

A specific example of such substance is pseudo-boehmite, which is most suitable as the substance to be used in the present invention. To provide it on a substrate, it is most preferred to prepare a sol of pseudo-boehmite and to have such sol geled on a substrate.

In the present invention, it is usual to employ a porous substance as the ink absorbent. As its physical properties, it is suitable to employ an average particle diameter of from 2 to 50 μm, an average pore diameter of from 80 to 500 Å and a pore volume of from 0.8 to 2.5 cc/g. Specific substrates having such physical properties include silica and aluminum hydroxide. Silica is most preferred. However, not more than 20% by weight of boria, magnesia, zirconia or titania may be incorporated.

In the present invention, the substance having the above-mentioned adsorptivity and the ink absorbent may be mixed. The mixture may be coated together with a binder in a single layer on the surface of a substrate such as paper. Otherwise, it is possible to employ various embodiments including a case wherein a layer of the substance having the above-mentioned adsorptivity is formed on a layer composed solely of the ink absorbent, and a case wherein a layer composed solely of the ink absorbent and a layer composed of the ink absorbent and the substance having the above-mentioned adsorptivity are provided in separate layers. Among these embodiments, it is particularly preferred that a layer (under layer) composed solely of the ink absorbent is first formed on the surface of a substrate such as paper and then a layer (upper layer) composed of the ink absorbent and the substance having the above-mentioned adsorptivity is formed on said under layer, since it is thereby possible to improve the color density and to obtain a sharp image.

To adopt such a construction, the ink absorbent for the under layer is selected to have a relatively large average particle diameter, and the ink absorbent for the upper layer is selected to have an average particle diameter smaller than that of the absorbent for the under layer. More specifically, it is preferred to employ a ratio of A/B within a rage of from 0.05 to 0.6 where A is the average particle diameter of the ink absorbent for the upper layer and B is the average particle diameter of the ink absorbent for the under layer.

Further, it is preferred that the average particle diameter of the ink absorbent for the upper layer is from 1 to 20 μm, and the average particle diameter of the ink absorbent for the under layer is from 2 to 50 μm.

Even in a case where the layer of the substance having the above-mentioned adsorptivity is not located at the top layer, good results can be obtained by providing two layers of ink absorbents having different particle diameters.

Namely, as such a construction, the upper and under layers composed solely of ink absorbents may be employed as mentioned above. More specifically, an under layer of ink absorbent having a relatively large particle diameter is formed of the surface of a substrate such as paper and an upper layer of ink absorber having a smaller averge particle diameter is formed thereon.

The physical properties of the upper and under layers and the ink absorbents constituting the respective layers may be the same as described above, respectively. In the present invention, a binder is employed to provide such substance on the surface of the substrate. Namely, a mixture of such substance and the binder is prepared and coated on the substrate.

As such a binder, polyvinyl alcohol is preferably employed. However, other binders including various modified polyvinyl alcohols such as cation-modified, anion-modified and silanol-modified polyvinyl alcohols, starch derivatives and their modified products, cellulose derivatives and styrene-maleic acid copolymers may suitably be used alone for in combination. A mixture of such substance with a binder may be applied on the substrate by using various means such as an air knife, a blade, a bar, a rod, a roll, a gravure or a sizing press.

In the present invention, the substance having the above-mentioned absorptivity is used preferably in an amount of from 5 to 50% by weight relative to the ink absorbent. If the amount is less than this range, the purpose of the present invention can not adequately be accomplished. On the other hand, if the amount exceeds this range, the ink absorption rate tends to be slow, and the substrate such as paper tends to absorb moisture and undergo deformation.

As an ink which may be used in the present invention, for example, a direct dye, an acid dye or food color is preferred.

When printing is conducted by using an ink containing a black color dye having an azo group, it is likely that the black color undergoes a color change to a brown color in a short period of time. In such a case, the color change may be prevented by incorporating a certain thioether type antioxidant to the recording medium. As such a thioether type antioxidant, a thioether compound having at least one thioether structure in the molecule as shown by the formula I may be employed:

$$R—S—R' \quad (I)$$

wherein each of R and R' is an atomic group such as an alkyl group or a phenyl group adjacent to the sulfur atom.

Specific examples of such compound include the following compounds:

$$S(CH_2CH_2C(=O)O—C_{12}H_{25})_2$$

-continued $$S(CH_2CH_2—C(=O)—O—C_{13}H_{27})_2$$

$$(H_{25}C_{12}SCH_2CH_2COOCH_2)_4C$$

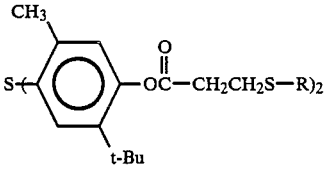

R: alkyl having from 12 to 14 carbon atoms.

Such antioxidants are capable of effectively preventing particularly the color change to brown of the azo type black ink called C.I. Food Black 2. The antioxidant is used usually in an amount of from 5 to 50% by weight, preferably from 15 to 30% by weight, relative to the ink jet recording medium.

Now, the present invention will be described in further detail with reference to Examples. However, it should be understood that the present invention is by no means restricted by such specific Examples.

In the Examples and Comparative Examples, various physical properties were measured as follows:

Color density: Solid prints of yellow, magenta, cyan were formed by color video printer RP 601 manufactured by Canon Inc., and the color densities were measured by Sakura PDA-45 reflective densitometer.

Resolution: One to four color patterns were printed by means of color image printer IO-720 manufactured by Sharp Corporation, and the degree of whiteness of the non-printed portions in the patterns was evaluated by 17 ratings of from 0 to 8 (every 0.5).

Ink absorption rate: A four-color pattern was printed by IO-720, whereby the time until the gloss disappeared from the surface after printing was measured.

Coating layer strength: In accordance with the pencil hardness as measured by JIS K5400. However, the load of 1 kg was changed to 300 g.

Water resistance: The printed image was exposed to running tap water for 10 minutes, whereupon the water resistance was evaluated by the presence or absence of blotting of the image.

EXAMPLE 1

A mixture comprising 1 part by weight of spherical silica particles having an average particle diameter of 15 μm, an average pore diameter of 150 Å and a pore volume of 1.6 cc/g, 25 parts by weight of alumina sol (pseudo-boehmite AS-3, manufactured by Catalysts & Chemicals Ind. Co., Ltd.) having an adsorptivity of 80 mg/g and a solid concentration of 7% by weight and 10 parts by weight of an aqueous solution containing 10% by weight of polyvinyl alcohol (PVA 117 manufactured by K. K. Kuraray) was prepared. The prepared mixture was coated on a high quality paper in an amount of 25 g/m$^2$ by a bar coater and then dried at 125° C. for one minute.

The printing properties of the recording sheet thus obtained are shown in Table 1.

EXAMPLE 2

One part by weight of spherical silica particles having an average particle diameter of 22 μm, an average pore diameter of 150 Å and a pore volume of 1.6 cc/g and 4 parts by weight of polyvinyl alcohol (as used in Example 1) as the binder were mixed, and the mixture was coated on a high quality paper in an amount of 25 mg/m$^2$ by a bar coater to obtain a base sheet.

Then, a mixture comprising 25 parts by weight of alumina sol (pseudo-boehmite AS-3 manufactured by Catalyst & Chemicals Ind. Co., Ltd.) having an adsorptivity of 80 mg/g and a solid concentration of 7% by weight and 10 parts by weight of an aqueous solution containing 10% by weight of polyvinyl alcohol (PVA 117 manufactured by K. K. Kuraray) was coated on the silica particle-coated surface of the base sheet in an amount of 8 g/m$^2$ by a bar coater and then dried at 125° C. for one minute.

The printing properties of the recording sheet thus obtained are shown in Table 1.

EXAMPLE 3

On the silica particle-coated surface of the same base sheet as used in Example 2, a mixture of spherical silica particles having the same physical properties and an average particle size of 6 μm and polyvinyl alcohol (70% by weight relative to the spherical silica particles of 6 μm) was coated in an amount of 8 g/m$^2$. Then, a mixture comprising 10 parts by weight of the same alumina sol as used in Example 2 and 1 part by weight of polyvinyl alcohol, was coated in the same manner as in amount of 8 g/m$^2$ and dried in the same manner.

The printing properties of the recording sheet thus obtained are shown in Table 1.

EXAMPLE 4

A partially saponified vinyl alcohol (PVA 217 manufactured by K. K. Kuraray) was coated on a transparent OHP sheet (Fuji Xerox Office Supply JE-001), and the mixture of silica sol (Cataloyed SI-350 manufactured by Catalysts & Chemicals Ind. Co., Ltd.) having a solid concentration of 30% by weight and polyvinyl alcohol as used in Example 2 was coated thereon in an amount of 16 g/m$^2$. Further, a mixture comprising 10 parts by weight of alumina sol (100 manufactured by Nissan Chemical Industries Limited) having an adsorptivity of 70 mg/g and a solid concentration of 10% by weight and 1 part by weight of an aqueous solution containing 10% by weight of polyvinyl alcohol (PVA 117) was coated in an amount of 8 g/m$^2$ and dried in the same manner as in Example 2.

The printing properties of the recording sheet thus obtained are shown in Table 1.

The light transmittance as a sheet for the OHP sheet was not impaired.

EXAMPLE 5

The recording sheet was prepared in the same manner as in Example 2 except that the alumina sol contained in the upper layer in the two layer coating in Example 2 was omitted.

The printing properties of the recording sheet are shown in Table 1.

TABLE 1

| | Color density | Resolution | Ink absorption rate | Coating layer strength | Water resistance |
|---|---|---|---|---|---|
| Example 1 | 2.80 | 7.0 | Not measurable (very fast) | 3H | Excellent |
| Example 2 | 2.97 | 6.5 | Not measurable (very fast) | 3H | Excellent |
| Example 3 | 3.05 | 5.5 | Not measurable (very fast) | 3H | Excellent |
| Example 4 | — | 6.0 | 0.3 sec. | 2H | Excellent |
| Example 5 | 2.90 | 6.5 | 0.3 sec. | 2H | Good |
| Comparative Example | 2.60 | 4.0 | 0.5 sec. | 2B | Bad |

COMPARATIVE EXAMPLE

The printing properties of the base sheet prepared in the same manner as in Example 2 were as shown in Table 1.

EXAMPLE 6

An aqueous slurry was prepared by mixing 10 parts by weight of spherical silica (average particle diameter: 22 μm, average pore diameter: 200 Å, pore volume: 1.6 cc/g), 280 parts by weight of the same alumina sol as used in Example 1 and 60 parts by weight of an aqueous solution containing 10% by weight of polyvinyl alcohol (PVA 117 manufactured by K. K. Kuraray) as an aqueous binder. The aqueous slurry thus obtained was coated on a high quality paper in an amount of 20 g/m$^2$ and dried to obtain a base sheet.

Then, $$S-(CH_2CH_2-\overset{\overset{\displaystyle O}{\|}}{C}-C-C_{12}H_{25})_2$$

(Sumilizer TPL-R manufactured by Sumitomo Chemical Co., Ltd.) was dissolved in acetone to obtain a 50 g/liter solution. This solution was coated on the silica-coated side of the base sheet in an amount of 5 g/m$^2$ to obtain a recording sheet.

The non-treated base sheet was used as a recording sheet for Comparative Example.

The recording sheets were subjected to printing with a black ink containing Food Black 2 as an azo type black dye by an ink jetting method by means of a color video printer RP-601 manufactured by Canon Inc., whereupon the printing properties and weather resistance were evaluated.

As a result, no substantial difference was observed in the printing properties between the Example and the Comparative Example. In each case, a good color density, resolution and ink absorption rate were obtained.

The weather resistance test was conducted in the following manner.

The recording sheets were left to stand for one month in a room having a good air circulation without direct sunshine, whereupon the color difference (ΔE) of the solid print portion between before and after being left to stand was measured by a color difference meter (manufactured by Nippon Denshoku Kogyo K.K.). The results are shown in Table 2.

EXAMPLE 7

A recording sheet was prepared in the same manner as in Example 6 except that

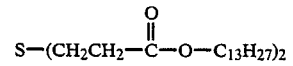

(Sumilizer TL manufactured by Sumitomo Chemical Co., Ltd.) was used instead of Sumilizer TPL-R used in Example 6.

Then, the evaluation was conducted in the same manner as in Example 6. The results are shown in Table 2.

TABLE 2

| | ΔE |
|---|---|
| Example 6 | 2.6 |
| Example 7 | 3.5 |
| Comparative Example | 25.6 |

In Comparative Example, the color change to brown was observed by visual observation. Whereas, in Examples 6 and 7 no substantial color change was observed by visual observation.

We claim:

1. A carrier medium for a coloring matter, which comprises a substrate having thereon a particulate ink absorbent, and a substance selected from the group consisting of alumina, alumina hydrate and pseudoboehmite present on the surface of the absorbent, which substance has an adsorptivity of from 20 to 100 mg/g.

2. The carrier medium for a coloring matter according to claim 1, wherein the ink absorbent has an average particle diameter of from 2 to 50 μm, an average pore diameter of from 80 to 500 Å and a pore volume of from 0.8 to 2.5 cc/g.

3. The carrier medium for a coloring matter according to claim 1 or 2, wherein the ink absorbent is silica.

4. The carrier medium for a coloring matter according to claim 1, wherein the substance having an adsorptivity of from 20 to 100 mg/g is alumina or alumina hydrate having a total volume of pores having radii of from 30 to 100 Å of from 0.2 to 1.5 cc/g.

5. The carrier medium for a coloring matter according to claim 1 or 4, wherein the substance having an adsorptivity of from 20 to 100 mg/g is pseudo-boehmite.

6. The carrier medium for a coloring matter according to claim 1, wherein the ink absorbent contains a thioether type antioxidant.

7. A carrier medium for a coloring matter, which comprises a substrate having thereon a particulate ink absorbent having a two layer structure comprising an under layer of ink absorbent having a relatively large particle diameter and an upper layer of ink absorbent having an average particle diameter smaller than that of the ink absorbent of the lower layer, and a substance selected from the group consisting of alumina, alumina hydrate and pseudoboehmite present on the surface of the absorbent, which substance have an adsorptivity of from 20 to 100 mg/g.

8. A carrier medium for a coloring matter, which comprises a substrate having thereon a particulate ink absorbent having a two layer structure comprising an under layer of ink absorbent having a relatively large average particle diameter and an upper layer of absorbent particles having an average particle diameter smaller than that of the ink absorbent of the lower layer, and a substance selected from the group consisting of alumina, alumina hydrate and pseudo-boehmite present on the surface of the upper layer of ink absorbent, which substance has an adsorptivity of from 20 to 100 mg/g.

9. The carrier medium for a coloring matter according to claim 7 or 8, wherein a ratio of A/B is from 0.05 to 0.6 where A is the average particle diameter of the ink adsorbent constituting the upper layer and B is the average particle diameter of the ink absorbent constituting the lower layer.

10. The carrier medium for a coloring matter according to claim 7 or 8, wherein the average particle diameter of the ink absorbent constituting the upper layer if from 1 to 20 μm and the average particle diameter of the ink absorbent constituting the under layer is from 2 to 50 μm.

11. The carrier medium for a coloring matter according to claim 7 or 8, wherein both the ink absorbent having a relatively large average particle diameter and the ink absorbent having a smaller average particle diameter have an average pore diameter of from 80 to 500 Å and a pore volume of from 0.8 to 2.5 cc/g.

12. The carrier medium for a coloring matter according to claim 8, wherein the substance having an adsorptivity of from 20 to 100 mg/g is alumina or alumina hydrate having a total volume of pores having radii of from 30 to 100 Å of from 0.2 to 1.5 cc/g.

13. The carrier medium for a coloring matter according to claim 8, wherein the substance having an adsorptivity of from 20 to 100 mg/g is pseudo-boehmite.

14. The carrier medium for a coloring matter according to claim 7 or 8, wherein at least one of the ink absorbent having a relatively large average particle diameter and the ink absorbent having a smaller average particle diameter contains a thioether type antioxidant.

* * * * *